US007086502B2

(12) United States Patent
Yim et al.

(10) Patent No.: US 7,086,502 B2
(45) Date of Patent: Aug. 8, 2006

(54) TRANSPORT APPARATUS AND METHOD HAVING CONFORMABLE GRIPPING CAPABILITY

(75) Inventors: Mark H. Yim, Palo Alto, CA (US); Kimon D. Roufas, Cambridge, MA (US); Craig Eldershaw, Tarragindi (AU)

(73) Assignee: Palo Alto Research Center Incorporated, Palo Alto, CA (US)

( * ) Notice: Subject to any disclaimer, the term of this patent is extended or adjusted under 35 U.S.C. 154(b) by 362 days.

(21) Appl. No.: 10/786,797

(22) Filed: Feb. 24, 2004

(65) Prior Publication Data

US 2005/0184543 A1 Aug. 25, 2005

(51) Int. Cl.
*A63B 27/00* (2006.01)
*E04G 3/00* (2006.01)

(52) U.S. Cl. ..... 182/136; 182/187; 182/133

(58) Field of Classification Search ..... 182/136, 182/187, 133; 248/925, 218.4, 284.1, 291.1; 403/52, 53
See application file for complete search history.

(56) References Cited

U.S. PATENT DOCUMENTS

| | | | | | |
|---|---|---|---|---|---|
| 1,924,033 | A * | 8/1933 | Flor | 52/149 |
| 2,009,474 | A * | 7/1935 | Castelli | 182/134 |
| 2,731,223 | A * | 1/1956 | Riccio | 248/511 |
| 2,854,293 | A * | 9/1958 | Riblet | 248/245 |
| 3,417,953 | A * | 12/1968 | Hillquist et al. | 248/284.1 |
| 4,793,439 | A | 12/1988 | Crawford | 182/136 |
| 5,170,975 | A * | 12/1992 | Chadwick | 248/284.1 |
| 5,213,172 | A | 5/1993 | Paris | 180/8.1 |
| 5,301,459 | A | 4/1994 | Eliachar et al. | 47/1.01 |
| 5,799,752 | A | 9/1998 | Perry | 182/206 |
| 6,315,259 | B1 * | 11/2001 | Kolb | 248/276.1 |
| 6,957,515 | B1 * | 10/2005 | Hatfield | 52/127.2 |

* cited by examiner

*Primary Examiner*—Hugh B. Thompson, II
(74) *Attorney, Agent, or Firm*—Linda M. Robb

(57) ABSTRACT

A transport apparatus for transporting materials or objects on substantially vertical structures for installation, deployment, inspection and repair purposes includes gripping mechanisms having a conformable gripping portion. The gripping mechanisms are separated by links, which are mutually attached to each other to permit angular rotation of the links relative to each other about a pivot point. A latching mechanism provides the capability for the gripping portion to be opened as well as secured for operation.

26 Claims, 4 Drawing Sheets

TRANSPORT APPARATUS AND METHOD HAVING CONFORMABLE GRIPPING CAPABILITY

INCORPORATION BY REFERENCE

The following U.S. patents are fully incorporated herein by reference: U.S. Pat. No. 4,793,439 to Crawford ("Apparatus for Climbing Trees, Poles and the Like and Being Remotely Controlled from Ground Elevation"); U.S. Pat. No. 5,213,172 to Paris ("Climbing Robot, Movable Along a Trestle Structure, Particularly of a Pole for High-Voltage Overhead Electric Lines") U.S. Pat. No. 5,301,459 to Eliachar et al. ("Tree Climbing Device"); and U.S. Pat. No. 5,799,752 to Perry ("Climbing Device").

BACKGROUND OF THE INVENTION

This invention relates generally to a transport apparatus and the like and specifically to a transport device for ascending or descending elevated structures to transport materials and equipment for installation, deployment, or repair purposes.

The technology available for power line/telephone maintenance, tree surgery, pipe maintenance, repair of high-masted poles (such as light poles), and the transport of objects such as sensors or communications equipment has utilized various approaches in accessing elevated locations to perform specific tasks. For example, devices such as pole and tree ladders provide support to a user as they climb a tree or pole. One such device is disclosed in U.S. Pat. No. 5,799,752 to Perry. In Perry, a clamp engages three sides of a tree trunk, gripping the tree between opposed arms of the clamp to which is attached a ladder. Apart from using ladders, trees or poles are scaled through the use of hand lines and/or climbing spurs. Lifting devices, which a person is raised to various heights, have also been employed, but these devices are expensive and slow-moving.

U.S. Pat. No. 5,301,459 to Eliachar et al. provides an alternate approach for climbing trees having straight trunks and no branches. The device of Eliachar, which is directed to the maintenance of palm trees, employs two pairs of arms, which are capable of opening and closing around a tree trunk and of climbing the tree trunk through the activation of hydraulic cylinders. Operation of the climbing unit is directed by a programmable controller. A remotely-controlled device for positioning equipment at working elevations is taught in U.S. Pat. No. 4,793,439 to Crawford. The apparatus of Crawford employs a frame having operating arms which at least partially encircle the tree or pole and secure the frame to the tree. A hydraulically driven telescoping mast also is equipped with gripping arms, which are hydraulically actuated independently of the gripping arms of the main frame. The gripping arms of the main frame and the hydraulically driven telescoping mast are sequentially activated to cause the apparatus to climb a tree or pole. The gripping arms fully retract to permit the apparatus to pass between limbs. A winch and cable system controlled by operating personnel provides for lifting objects, such as tools, to the working level or for lowering objects, such as cut branches, to the ground.

An alternate approach is found in U.S. Pat. No. 5,213,172 to Paris, a robotic device for climbing trestles, particularly poles for overhead electric lines includes a primary support body with internal movable slides. The slides carry arms attached to gripping hands, which grasp the pole such that the gripping hands are in a perpendicular position relative to the pole. A slot within the support body enables the slide to move up or down within the support, thus enabling the arms to move up or down to move along the pole as the gripping hands are alternately opened and closed.

However, there are numerous disadvantages to existing approaches for scaling tall structures for repair, maintenance, or the installation or deployment of equipment. Existing remotely controlled devices have been narrowly directed to the movement of tools to a work location or to the maintenance of specific types of trees or electric lines. It is desirable to provide an apparatus that is capable of safely and efficiently climbing trees, poles, posts, pipes, etc. while being under the control of personnel at ground level, and, when in position, performing varied maintenance, installation, deployment and/or repair tasks.

SUMMARY OF THE INVENTION

The disclosed embodiments provide examples of improved solutions to the problems noted in the above Background discussion and the art cited therein. There is shown in these examples an improved transport apparatus for transporting materials or objects on substantially vertical structures for installation, deployment, inspection and repair purposes includes gripping mechanisms having a conformable gripping portion. The gripping mechanisms are separated by links, which are mutually attached to each other to permit angular rotation of the links relative to each other about a pivot point. A latching mechanism provides the capability for the gripping portion to be opened as well as secured for operation.

In another embodiment there is disclosed a method for operating a transport apparatus for transporting materials or objects on substantially vertical structures for installation, deployment, or repair purposes. The transport device includes conformable gripping mechanisms operatively connected to links separating the gripping mechanisms, such that at least two of the links are spaced between each of the gripping mechanisms. The links are mutually attached to permit angular movement of the links relative to each other about a pivot point. A controller causes the transport apparatus to engage a substantially vertical structure in at least two locations with the conformable gripping mechanisms. A first conformable gripping mechanism is brought into perpendicular relationship with the structure at a first position and is then disengaged from the structure. The first gripping mechanism is then moved to a second position on the structure that approaches a second gripping mechanism which is in a conformed relationship with the structure. The first gripping mechanism grips the structure at the second position by forming a conformed relationship with the structure. The angular relationship of at least two of the links is decreased, to bring the second gripping mechanism into perpendicular relationship with the structure at a third position. The second gripping mechanism is then disengaged from the structure and is moved to a fourth position along the structure that is more removed from the position of the first gripping mechanism by increasing the angular relationship of at least two of the links. The second gripping mechanism grips the structure at the fourth position by forming a conformed relationship with the structure. The sequence of bringing a gripping mechanism into perpendicular relationship with the structure, disengaging a gripping mechanism, moving the disengaged gripping mechanism to a new position and gripping the structure by forming a conformed relationship between the structure and the gripping mechanism is repeated until the desired location is reached on the structure.

BRIEF DESCRIPTION OF THE DRAWINGS

The foregoing and other features of the instant invention will be apparent and easily understood from a further reading of the specification, claims and by reference to the accompanying drawings in which:

DETAILED DESCRIPTION OF THE INVENTION

The transport apparatus and method disclosed herein provide the capability for accessing elevated sites, which a human cannot reach without difficulty or without encountering safety risks. Such sites include, but are not limited to, structures that will not support the weight of a person, areas that may be obstructed (for example, deep into a tree or a bridge), or locations close to high voltage lines. Several characteristics are necessary in a device to access these sites, such as the ability of the device to grip and release the structure it is climbing or descending as well as the ability to move at least bi-directionally along the structure being scaled.

Figure 1:
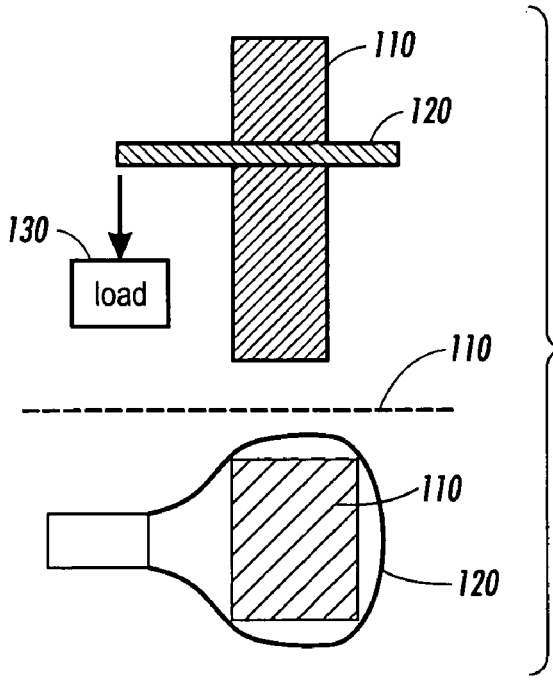
FIG. 1 illustrates the transport mechanism in its non-gripping position.

FIG. 1 provides a simplified diagram of one embodiment of the conforming gripping mechanism disclosed herein and its manner of engaging the structure. In the side view in this figure, structure 110 is engaged by gripping mechanism 120 to which load 130 is attached. The top view shows conformable gripping mechanism 120 in its engaged but non-gripping position around structure 110. Conformable gripping mechanism 120 may take any of numerous forms known in the art and may be generally angular or rectilinear in shape or a combination of curvilinear and rectilinear features, all of which are contemplated by this disclosure and the scope of the claims herein. The conformable gripping mechanism may be engaged onto the structure 110 by the user, or it may be autonomously engaged. The transport apparatus may either assume that the conformable gripping mechanism is properly engaged, in those configurations operating open loop without sensing, or contact, touch, or force sensors may be incorporated into the transport apparatus to ensure proper engagement. If improper engagement is sensed, control software reacts to this and applies appropriate measures such as re-attempting engagement or attempting engagement at a different location.

Figure 2:
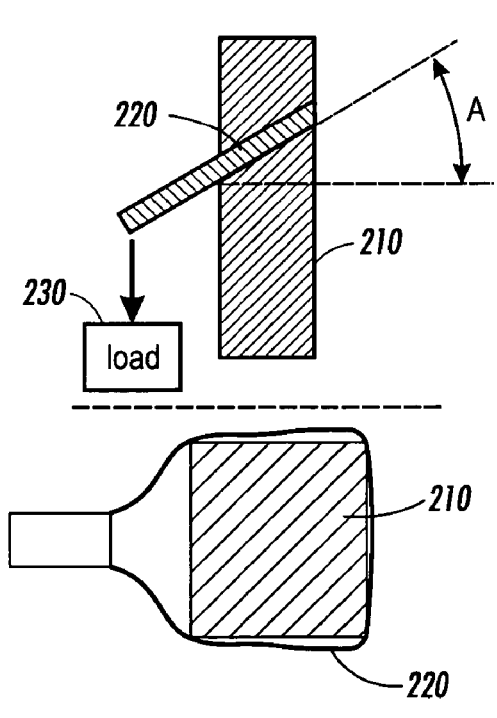
FIG. 2 illustrates the transport mechanism in its gripping position.

Referring now to FIG. 2, the operational position of the conformable gripping mechanism is illustrated. In the side view of the operational position, gripping mechanism 220 engages structure 210 at an angle A, with gripping mechanism 220 supporting load 230. In the top view, gripping mechanism 220 is seen conforming itself to the outer surface of structure 210, which results when gripping mechanism 220 is inclined at the angle A such that the angular cross-section of the engaged portion of structure 210 interferes with the available internal dimension of conformable gripping mechanism 220. Angle A may vary and is dependent on the length of gripping mechanism 220 and the circumference of structure 210, as well as the frictional characteristics of the structure and the material(s) comprising the gripping mechanism. As can be observed, conformable gripping mechanism 220 deforms to approximately assume the shape of the structure 210. While structure 210 is illustrated as being rectilinear in cross-section, it will be noted that structure 210 could have numerous cross-sectional configurations, including curvilinear or combinations of curvilinear and rectilinear forms.

Figure 3:
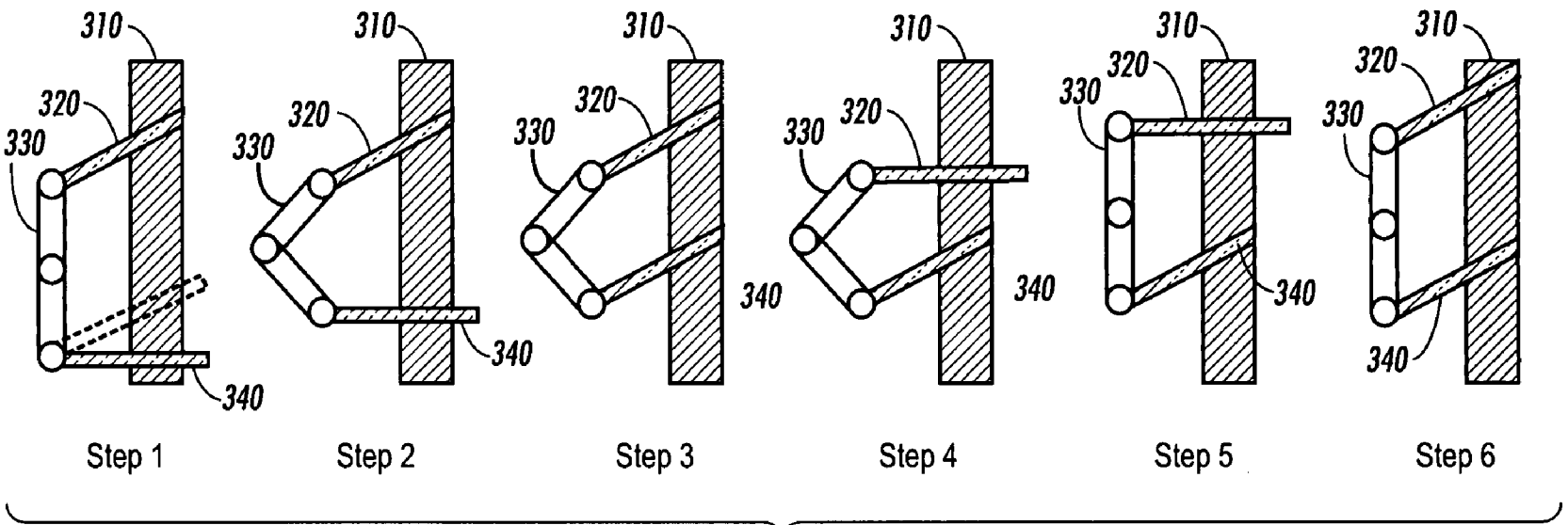
FIG. 3 illustrates the operational steps for the transport apparatus.

Turning now to FIG. 3, the sequence of operations enabling the transport mechanism to move along a structure is illustrated. At the first step, conformable gripping mechanisms 320 and 340 are in engaged positions on structure 310, with linkages 330 connecting conformable gripping mechanisms 320 and 340. Linkages 330 are in an extended configuration to maximize the distance between the connected ends of conformable gripping mechanisms 320 and 340. Conformable gripping mechanism 320 has deformed to assume the shape of structure 310, while conformable gripping mechanism 340 is engaged with the structure and retains its original shape as it begins to move along the surface of structure 310 to a second position (shown as dashed lines). Example materials from which the linkages may be fabricated include metals, woods, plastics, or other rigid or semi-rigid materials. Conformable gripping mechanisms 320 and 340 may be fabricated from various materials known in the art, for example sheet metal, polymers, or wire either coated or uncoated in appropriate gauges.

At step two, linkages 330, which include actuators (not shown), move to an angular position relative to each other, thus reducing the distance between gripping mechanisms 320 and 340 by moving conformable gripping mechanism 340 closer to gripping mechanism 320. Conformable gripping mechanism 340 returns to its original, unconformed condition as it releases and reaches a position perpendicular to structure 310 while conformable gripping mechanism 320 remains in its deformed, gripping condition conformed to structure 310. At step three, conformable gripping mechanism 340, which has moved to a new location on structure 310, deforms to grip structure 310. Conformable gripping mechanism 320 remains in its original deformed, gripping condition and linkages 330 remain in angular relationship to each other. At step four, conformable gripping mechanism 320 releases the structure as linkages 330 begin to increase their angular relationship to each other, thereby causing conformable gripping mechanism 320 to move to an approximately perpendicular position relative to structure 310. Conforming gripping mechanism 340 remains in its deformed, gripping condition.

At step 5, linkages 330 have moved to a fully extended position, which maximizes the distance between the attached ends of conforming gripping mechanisms 320 and 340. Gripping mechanism 340 remains in its deformed, gripping condition and conforming gripping mechanism 320, which has returned to its original shape, moves along structure 310. Finally, at step 6 conforming gripping mechanism 320 deforms and grips structure 310 at its new position. Conforming gripping mechanism 340 remains deformed and gripping structure 310 and linkages 330 remain in a fully extended configuration. At this point the sequence of steps may be repeated to continue movement of the transport mechanism along the structure. Although only two links are illustrated in the figures herein, it will readily be appreciated that in an alternate embodiment more than two links could be beneficially employed to move the apparatus along a surface. The motor causing the movement of the links is included within the structure of the links. A controller (not shown) may be either included in the structure, attached separately to the structure, or included in a remote control module.

Figure 4:
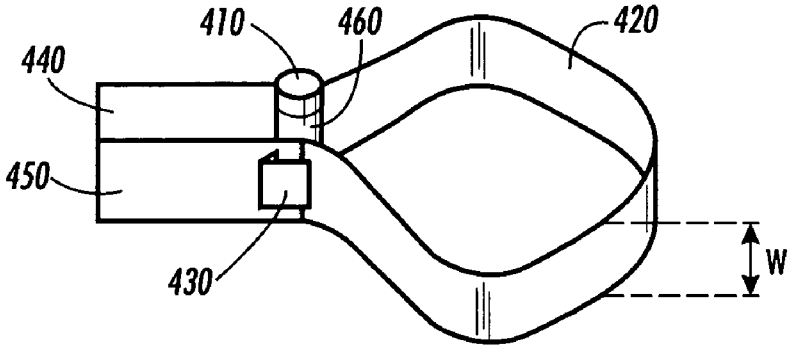
FIG. 4 illustrates an embodiment of the transport mechanism in its unengaged condition.

Referring to FIG. 4, there is shown an example embodiment of a conforming gripping mechanism in its unconformed condition. In this embodiment one end of gripping portion 420 is connected to attachment point 410, which holds an actuator enabling gripping portion 420 to move in a plane perpendicular to the structure to engage the structure. The length of gripping portion 420 may be adjusted manually prior to engagement with the structure or may be replaced with an alternate gripping portion having a different length. Optionally, a second actuator 460 may have the ability to change the length of gripping portion 420 by either retracting or releasing excess conformal material. Varying the length of the gripping portion allows the adjustment of the length of gripping portion 420 such that angle A (shown in FIG. 2) is appropriate to allow gripping of the structure over a variety of structure sizes and configurations. Latching mechanism 430, which may be any of various latch mechanisms known in the art, enables gripping surface 420 to close around the structure. Extensions 440 and 450 connect to linkages (not shown) extending between associated gripping mechanisms and also space the body of the transport mechanism from the structure along which it is moving. Gripping portion 420 has a width dimension w, which is dependent on the weight to be lifted, the circumference of the structure along which the mechanism is moving, and the material from which the conformable gripping mechanism is fabricated. Additionally, width w may vary, for example, the gripping surface may have a greater width adjacent to extensions 440 and 450 and a lesser width in the conforming surface.

Gripping portion 420 may be fabricated from various materials known in the art, for example sheet metal, polymers, or wire either coated or uncoated in appropriate gauges. To enhance gripping capability, the inner surface of gripping portion 420 may be abraded or include a coating, particularly in those applications in which the structure to be scaled has a smooth surface. The inside of gripping portion 420 may also have features such as hooks or spikes of various sizes to grasp or penetrate the structure. Alternatively, gripping portion 420 may be fabricated from two layered materials, such that the inner material forms the gripping surface and the outer material provides support and conformability. The inner material may be a softer yielding material such as rubber or other polymers while the outside material may be thin metal such as beryllium copper, steel or more rigid plastic.

Figure 5:
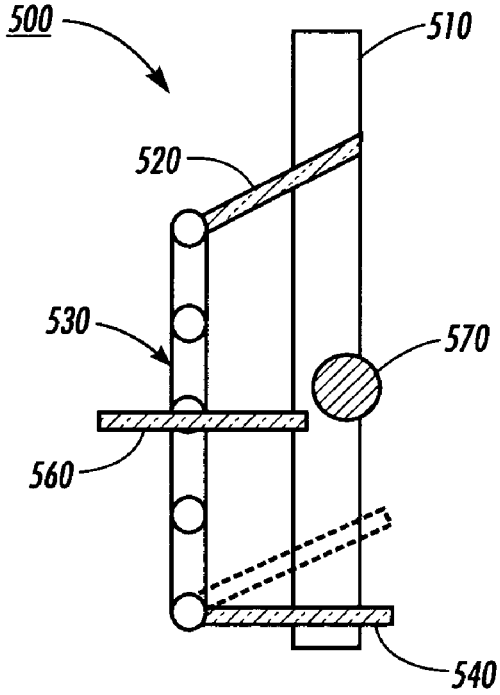
FIG. 5 illustrates the operation of the apparatus as it moves around obstacles in its path.

In addition to moving along a structure, an alternate embodiment of the apparatus described herein is capable of moving around obstacles on a structure by engaging and disengaging the structure as needed. FIG. 5 illustrates one such configurational embodiment as the transport apparatus moves along a structure 510 and encounters an obstacle 570. Here transport apparatus 500 includes at least three gripping mechanisms 520, 540, and 560 connected by linkages 530, with at least two of gripping mechanisms 520, 540 and 560 in the form of conformable gripping mechanisms. For the purposes of illustration, in this embodiment gripping mechanisms 520 and 540 are conformable gripping mechanisms. When gripping mechanism 560 encounters obstacle 570 on structure 510, it rotates outward to disengage from structure 510 while the remaining gripping mechanisms continue moving along the structure. Examples of obstacles 570 include branches or attachments to the structure. Although three gripping mechanisms connected with two linkages between each gripping mechanism are illustrated, it will be appreciated that a plurality of gripping mechanisms and linkages may be utilized in the transport apparatus and such configurations are fully contemplated by this specification and the scope of the claims herein.

In FIG. 5 gripping mechanism 520 has already encountered obstruction 570, disengaged from structure 510 as gripping mechanisms 560 and 540 continue to move apparatus 500 along structure 510. Although not shown in this figure gripping mechanism 560 re-engages with structure 510 after obstacle 570 has been passed. Apparatus 500 then continues moving along structure 510 until conformable gripping mechanism 560 encounters the obstacle. Conformable gripping mechanism 560 would then disengage from structure 510 to clear the obstacle while gripping mechanism 520 remains in its conformed condition and gripping mechanism 540 has moved to a perpendicular relationship with structure 510 preparatory to moving along the structure. Complete disengagement with the structure is accomplished without sensors through translation of the gripping mechanism through a specified range of movement. For those embodiments in which sensors are included, sensors measure either the change of forces internal to the structure, or touch, force, or contact sensors detect disengagement.

As described hereinabove with reference to FIG. 3, linkages 530 move from angular to fully extended positions to enable movement of apparatus 500 along the structure. When the transport apparatus 500 has moved sufficiently for gripping mechanism 560 to clear obstruction 570, gripping mechanism 560 swings back into engagement with structure 510. Similarly, when gripping mechanism 520 encounters an obstacle, it disengages and swings away from structure 510 as gripping mechanisms 560 and 540 continue to climb. When gripping mechanism 540 encounters obstacle 570, gripping mechanisms 520 and 560 continue climbing as gripping mechanism 540 disengages from structure 510. This engagement and disengagement sequence of movements enables the apparatus to transition from climbing to translation along a horizontal bar or a horizontal cable, as well as descending a structure.

For those embodiments in which the apparatus is remotely controlled, an operator directs the movement of the apparatus to clear an obstacle. For those embodiments in which the apparatus operates autonomously, touch, force, or contact sensors sense contact with the obstacle. An on-board controller (not shown in the Figures) then causes the colliding arm to move out of the way of the obstacle. The on-board controller may then either continuously attempt re-engagement as the rest of the system climbs (for example, repeatedly touching and sensing the obstacle until the obstacle is cleared), or it may sense the obstacle without contact, through proximity sensing.

Figure 6:
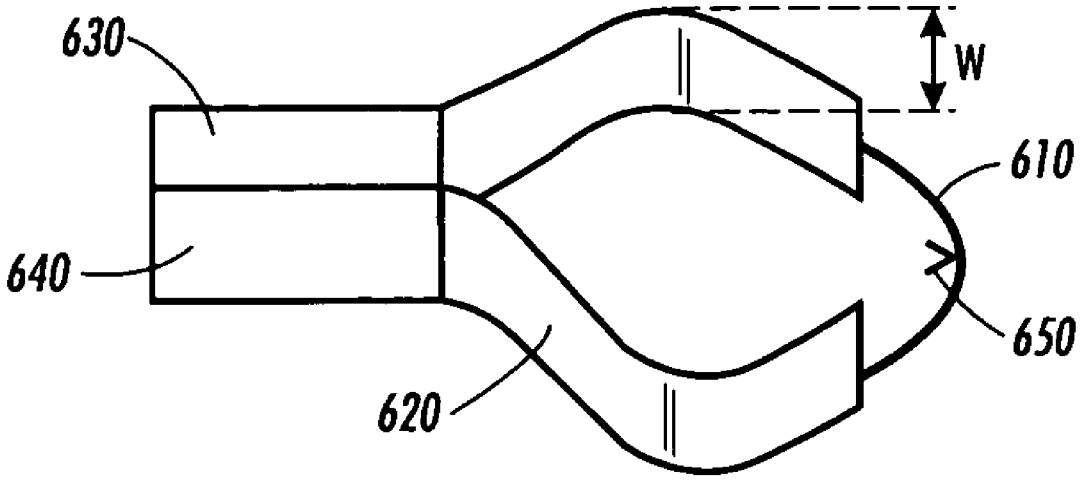
FIG. 6 illustrates an alternate embodiment for the conformable gripping mechanism.

Turning now to FIG. 6, there is shown another embodiment of the conforming gripping mechanism in its unconformed condition. In this embodiment the gripping portion of the conformable gripping mechanism includes side segments 620 and center segments 610. Center segments 610 may be in the form of a semi-rigid wire having ends which may be latched or manually formed to engage a structure. Examples of such wire materials include but are not limited to beryllium copper, spring steel, stainless steel, or aluminum. Side segments 620 have a width dimension w, which is partly dependent on the weight to be lifted, the circumference of the structure along which the mechanism is moving, and the material from which the conformable gripping mechanism is fabricated. Additionally, width w may vary, for example, the gripping surface may have a greater width adjacent to extensions 630 and 640 and a lesser width at the attachment to center segments 610. Side segments 620 may be fabricated from various materials known in the art, for example sheet metal or polymers.

While for the purposes of this embodiment side sections 620 and center sections 610 together form the gripping surface, it will be noted that side sections 620 may be shorter in length, such that center sections 610 provide the sole gripping surface. To enhance gripping capability in those instances in which both sections 610 and 620 form a gripping surface, the inner surface of side sections 620 may be abraded or include a coating, particularly in those applications in which the structure to be scaled has a smooth surface. Alternatively, side sections 620 may be fabricated from two layered materials, such that the inner material forms the gripping surface and the outer material provides support and conformability.

Extensions 630 and 640 connect to linkages (not shown) extending between associated gripping mechanisms and also space the body of the transport mechanism from the structure along which it is moving. As will be appreciated by one skilled in the art, this embodiment may also include an actuator to permit gripping portions 610 and 620 to move in a plane perpendicular to the structure to engage the structure.

While the present discussion has been illustrated and described with reference to specific embodiments, further modification and improvements will occur to those skilled in the art. For example, the apparatus is also able to move along structures that are semi-flexible or not precisely straight, such as piping, which includes bends or curved structural supports. It is to be understood, therefore, that this disclosure is not limited to the particular forms illustrated and that it is intended in the appended claims to embrace all alternatives, modifications, and variations which do not depart from the spirit and scope of the embodiments described herein.

What is claimed is:

1. A transport apparatus for transporting materials or objects on substantially vertical structures for installation, deployment, inspection or repair purposes, comprising:

a plurality of gripping mechanisms, wherein said plurality of gripping mechanisms include a conformable gripping portion;

at least one actuator for varying the length of said conformable snipping portion;

a plurality of links separating and operatively attached to said plurality of gripping mechanisms, wherein said links are mutually attached to permit angular movement of said links relative to each other about a pivot point; and a latching mechanism operative connected to said gripping portion, for enabling said gripping portion to close around the substantially vertical structure.

2. The transport apparatus according to claim 1, wherein said gripping mechanism is rectilinear in shape.

3. The transport apparatus according to claim 1, wherein said gripping mechanism is curvilinear in shape.

4. The transport apparatus according to claim 1, wherein said gripping mechanism is characterized by both curvilinear and rectilinear features.

5. The transport apparatus according to claim 1, further comprising extensions connecting said links with said gripping mechanisms, wherein said extensions separate the links from the surface of the substantially vertical structure.

6. The transport apparatus according to claim 1, wherein said conformable gripping portion has a width dimension, wherein said width dimension is variable along the length of the gripping portion.

7. The transport apparatus according to claim 1, wherein said conformable gripping portion has a width dimension, wherein said width dimension is uniform along the length of the gripping portion.

8. The transport apparatus according to claim 1, wherein said conformable gripping portion includes a coating on the surface of the gripping portion contacting the surface of the substantially vertical structure.

9. The transport apparatus according to claim 1, wherein said conformable gripping portion comprises a plurality of layered materials, such that an inner maternal forms the surface gripping the substantially vertical structure and an outer material provides conforming capability.

10. The transport apparatus according to claim 1, wherein said gripping mechanism comprises a plurality of side segments and a plurality of center segments.

11. The transport apparatus according to claim 10, wherein said gripping portion comprises both said plurality of side segments and said plurality of center segments.

12. The transport apparatus according to claim 10, wherein said gripping portion comprises said plurality of center segments.

13. The transport apparatus according to claim 1, further comprising at least one sensor for sensing engagement or disengagement with the substantially vertical structure, or obstacles occurring on said the substantially vertical structure, wherein said sensor is incorporated into said gripping mechanism.

14. The transport apparatus according to claim 13, wherein said at least one sensor comprises touch sensors.

15. The transport apparatus according to claim 13, wherein said at least one sensor comprises force sensors.

16. The transport apparatus according to claim 13, wherein said at least one sensor comprises contact sensors.

17. The transport apparatus according to claim 1, further comprising a controller for directing operation of the transport apparatus.

18. The transport apparatus according to claim 17, wherein said controller comprises an on-board controller.

19. The transport apparatus according to claim 17, wherein said controller comprises a remote controlling device.

20. The transport apparatus according to claim 17, further comprising software directing movement of the climbing apparatus.

21. The apparatus for climbing objects according to claim 1, wherein said plurality of gripping mechanisms comprises two gripping mechanisms.

22. The apparatus for climbing objects according to claim 1, wherein said not less than two links comprises two links.

23. The apparatus for climbing objects according to claim 1, further comprising at least one actuator for enabling said gripping mechanism to move in a plane perpendicular to the substantially vertical structure to disengage said gripping mechanism from the structure.

24. A method for operating a transport apparatus for transporting materials or objects on substantially vertical structures for installation, deployment, or repair purposes, said transport device including a plurality of conformable gripping mechanisms operatively connected to a plurality of links separating and operatively attached to the plurality of gripping mechanisms, wherein at least two of the links are spaced between each of the plurality of gripping mechanisms, and wherein the links are mutually attached to permit angular movement of the links relative to each other about a pivot point, and a controller, the method comprising:

engaging a substantially vertical structure in at least two locations with the conformable gripping mechanisms;

bringing a first conformable gripping mechanism into perpendicular relationship with said structure at a first position;

disengaging said first gripping mechanism from said structure;

moving said first gripping mechanism to a second position on said structure that approaches a second gripping mechanism which is in a conformed relationship with said structure;

gripping said structure with said first gripping mechanism at said second position by forming a conformed relationship with said structure;

decreasing the angular relationship of at least two of the plurality of links, wherein the movement of said at least two links brings said second gripping mechanism into perpendicular relationship with said structure at a third position;

disengaging said second gripping mechanism from said structure;

moving said second gripping mechanism to a fourth position along said structure that is more removed from the position of said first gripping mechanism by increasing the angular relationship of at least two of the plurality of links;

gripping said structure with said second gripping mechanism at said fourth position by forming a conformed relationship with said structure;

repeating the sequence of bringing a gripping mechanism into perpendicular relationship wit said structure, disengaging a gripping mechanism, moving the disengaged gripping mechanism to a new position, and gripping said structure by forming a conformed relationship between said structure and the gripping mechanism until the desired location is reached on said structure.

25. The method for operating a transport apparatus according to claim 24, wherein the controller directs the movement of the plurality of gripping mechanisms and the plurality of links.

26. The method for operating a transport apparatus according to claim 24, wherein the transport apparatus further includes at least three conformable gripping mechanisms operatively connected to the plurality of links such that at least two of the links are spaced between each of the at least three of gripping mechanisms, and wherein the links are mutually attached to permit angular movement of the links relative to each other about a pivot point, and at least one actuator operatively attached to each of said gripping mechanisms to enable the gripping mechanism to be angularly removed from the structure, method further comprising:

removing at least one of said gripping mechanisms from engagement with the structure as the transport apparatus moves along the surface of the structure, wherein removing comprises rotating said at least one gripping mechanism outward from the structure;

returning said removed gripping mechanism to engagement with the structure as the transport apparatus moves along the surface of the structure, wherein returning comprises rotating said removed gripping mechanism inward to engage the structure.

* * * * *

UNITED STATES PATENT AND TRADEMARK OFFICE

CERTIFICATE OF CORRECTION

PATENT NO. : 7,086,502 B2
APPLICATION NO. : 10/786797
DATED : August 8, 2006
INVENTOR(S) : Mark H. Yim et al.

It is certified that error appears in the above-identified patent and that said Letters Patent is hereby corrected as shown below:

Column 1, line 4, insert as a new paragraph:

This invention was made with Government support under MDA972-98-C-0009 awarded by DARPA. The Government has certain rights in this invention.

Signed and Sealed this

First Day of May, 2007

JON W. DUDAS
*Director of the United States Patent and Trademark Office*